US009675869B1

(12) United States Patent
Chin

(10) Patent No.: US 9,675,869 B1
(45) Date of Patent: Jun. 13, 2017

(54) JUMPING PLATFORM AND EXTENDABLE JUMPING PLATFORM ASSEMBLY COMPRISING THE SAME

(71) Applicant: T. K. CHIN COMPANY LTD., Taipei (TW)

(72) Inventor: Howard Chin, Taipei (TW)

(73) Assignee: T. K. CHIN COMPANY LTD., Taipei (TW)

( * ) Notice: Subject to any disclaimer, the term of this patent is extended or adjusted under 35 U.S.C. 154(b) by 0 days.

(21) Appl. No.: 15/293,576

(22) Filed: Oct. 14, 2016

(30) Foreign Application Priority Data

Jun. 20, 2016 (TW) ..... 105119281 A

(51) Int. Cl.
*A63C 19/10* (2006.01)
*A63G 21/00* (2006.01)

(52) U.S. Cl.
CPC ..... *A63C 19/10* (2013.01); *A63C 2203/10* (2013.01)

(58) Field of Classification Search
CPC ..... A63C 19/00; A63C 19/10; A63G 21/00; A63G 31/00
USPC ..... 472/85–90; 14/69.5, 71.1, 72.5; 104/275–277
See application file for complete search history.

(56) References Cited

U.S. PATENT DOCUMENTS 5,066,000 A * 11/1991 Dolan ..... A63B 23/0464 472/90
6,654,977 B1 * 12/2003 Chin ..... A63C 19/10 14/69.5
6,672,968 B2 * 1/2004 Montolio ..... A63C 19/10 14/69.5
6,676,529 B2 * 1/2004 Pernal ..... A63C 19/10 472/89
6,993,801 B2 * 2/2006 Marko ..... A63C 19/10 14/69.5

* cited by examiner

*Primary Examiner* — Kien Nguyen
(74) *Attorney, Agent, or Firm* — Rabin & Berdo, P.C.

(57) ABSTRACT

The jumping platform has a lateral mounting portion and a lateral lapping portion respectively formed on two lateral surfaces of the jumping platform. The extendable jumping platform assembly has multiple jumping platforms, multiple extending boards, and a jumping board. The jumping platform assembly has a lateral mounting portion and a lateral lapping portion so that the jumping platforms and the extending boards can be juxtaposed for extending lateral leaping range safely and extending sliding length according to the usage. One end of the extending board is mounted on the jumping platform, the other end of the extending board is mounted on the jumping board, and each one of the extending board and the jumping board has a leg assembly for supporting.

11 Claims, 15 Drawing Sheets

JUMPING PLATFORM AND EXTENDABLE JUMPING PLATFORM ASSEMBLY COMPRISING THE SAME

CROSS-REFERENCE TO RELATED APPLICATIONS

This application is based upon and claims priority under 35 U.S.C. 119 from Taiwan Patent Application No. 105119281 filed on Jun. 20, 2016, which is hereby specifically incorporated herein by this reference thereto.

BACKGROUND OF THE INVENTION

1. Field of the Invention

The present invention relates to sport equipment, especially to extreme sport equipment.

2. Description of the Prior Arts

Extreme sport is a good choice for someone who likes adventures and exciting sports. When doing the extreme sport, the player dives and accelerates to leap from the ground. Following that, the player falls at very high speed to the ground. During the extreme sport, the player experiences the thrill generated by the variations of the acceleration and the freefall. In order to leap and slide during the extreme sport, the player may get assistance with a platform.

Please refer to FIGS. 10 and 11; one of the conventional extendable jumping platform assemblies has two jumping platforms 50 and a connecting board 60. A sliding portion 51 on a top surface of each jumping platform 50 is a curved surface and the height of the sliding portion 51 varies from low to high. The jumping platform 50 forms a docking portion 52 at the higher end of the sliding portion 51. The two docking portions 52 of the two jumping platforms 50 face to each other. Two opposite sides of a top surface 61 of the connecting board 60 are two connecting portions 62, and the two connecting portions 62 are capable of being mounted on the two docking portions 52 of the two jumping platforms 50, thereby completing the installation of the conventional extendable jumping platform assembly. Precisely, each docking portion 52 forms two mounting grooves 521, and each connecting portion 62 forms two corresponding mounting tenons 621, so that the mounting tenons 621 can be mounted in the mounting grooves 521. When using the extendable jumping platform assembly, the player moves at a high speed toward one of the jumping platforms 50 of the conventional extendable jumping platform assembly with a skateboard, a bicycle, or skates. With the curved sliding portion 51 and the height variation of the sliding portion 51, the player can slide or leap on one of the jumping platforms 50, and then back to the ground by the other jumping platform 50. During this process, the player can stay on the top surface 61 of the connecting board 60 and enjoy the admiration from spectators.

However, the shape of the conventional extendable jumping platform assembly is regular and uniform so that the conventional extendable jumping platform assembly can neither extend the lateral leaping range according to different usage demands, nor extend a length of the sliding portion 51 for changing leaping heights of the conventional extendable jumping platform assembly.

Then please refer to FIGS. 12 and 13. Another conventional extendable jumping platform assembly is installed by two juxtaposed jumping platforms 70 to increase a lateral leaping range. A top surface of each jumping platform 70 is a sliding portion 71, and the highest end of the sliding portion 71 is a jumping end 711. One lateral surface of the jumping platform 70 forms a plurality of mounting grooves 72 spaced from each other, and the other lateral surface of the jumping platform 70 forms a plurality of mounting tenons 73 spaced from each other; besides, the mounting tenons 73 are corresponding to the mounting grooves 72 in location. During installation, the mounting tenons 73 of one jumping platform 70 are mounted in the mounting grooves 72 of the other jumping platform 70, so that juxtaposition of the two jumping platforms 70 is accomplished.

Please also refer to FIGS. 14 and 15. The jumping platform 70 further forms a plurality of lapping grooves 74 spaced from each other on an end surface of the jumping platform 70, which allows the jumping platform 70 to assemble with a first extending platform 80 and a second extending platform 90 for extending the sliding length and changing the leaping height of the conventional extendable jumping platform assembly. The first extending platform 80 has a first base portion 81 on the bottom surface thereof and a sliding portion 82 on the top surface thereof. A lower end of the sliding portion 82 is a guiding end 821 and the higher end of the sliding portion 82 is a jumping end 822. An end surface of the first extending platform 80 corresponding to the jumping end 822 forms a plurality of lapping grooves 84, and the other end surface of the first extending platform 80 corresponding to the guiding end 821 forms a plurality of lapping tenons 83. The lapping tenons 83 can be mounted in the lapping grooves 74 of the jumping platform 70, which causes the jumping end 711 of the jumping platform 70 to connect the guiding end 821 of the first extending platform 80. The second extending platform 90 has a second base portion 91, a sliding portion 92, and a plurality of lapping tenons 93. The sliding portion 92 has a guiding end 921 and a jumping end 922. The structures of the second extending platform 90 and the first extending platform 80 are almost the same, but the differences between them are that the second base portion 91 is bigger than the first base portion 81, and the second extending platform 90 does not have any lapping groove. The lapping tenons 93 of the second extending platform 90 can be mounted in the lapping grooves 84 of the first extending platform 80, which causes the guiding end 921 of the second extending platform 90 to connect the jumping end 822 of the first extending platform 80.

However, after the two jumping platforms 70 are juxtaposed for extending the lateral leaping range, as shown in FIG. 12, the aforesaid another conventional extendable jumping platform assembly forms an obvious serrated joint seam 700 between the two jumping platforms 70. Therefore, when the player moves at a high speed on a surface of the sliding portion 71 of the two jumping platforms 70, the serrated joint seam 700 may make wheels of the skateboard, bicycle, or skates shake in instability, causing safety hazards. Besides, to extent the sliding length, heights of the additional first extending platform 80 and second extending platform 90 have to correspond to the leaping height of the conventional extendable jumping platform assembly. In other words, the height of the first base portion 81 and the second base portion 91 must be increased, and the volumes of the first base portion 81 and the second base portion 91 are also increased, which increases the costs of material and molding of the first extending platform 80 and the second extending platform 90, too. Furthermore, because of the increased volumes of the first base portion 81 and the second base portion 91, the cost of packaging is increased as well.

To overcome the shortcomings, the present invention provides an extendable jumping platform assembly to mitigate or obviate the aforementioned problems.

SUMMARY OF THE INVENTION

The main objective of the present invention is to provide a jumping platform and an extendable jumping platform assembly for mitigating or obviating shortages of the conventional jumping platform that is dangerous after assembling in both lateral direction and lengthwise direction, and that the cost of producing and packaging is high. With the present invention, the jumping platform and the extending board can be assembled and extended safely in a lateral direction and in sliding length, and decrease the volume of the extending board and the cost of packaging.

The jumping platform has:

a sliding portion being a curved surface and formed on a top surface of the jumping platform, the sliding portion comprising:

a guiding end at the lowest end of the jumping platform; and a jumping end at the highest end of the jumping platform; a height of the sliding portion increasing from the guiding end to the jumping end in a longitudinal direction of the jumping platform;

a lateral mounting portion protruding from a lateral surface of the jumping platform, a top surface of the lateral mounting portion being lower than a top surface of the sliding portion, the lateral mounting portion and the sliding portion having the same curvature variations;

a lateral lapping portion protruding from another lateral surface of the jumping platform and curved along with the curved surface of the sliding portion, a thickness of the lateral lapping portion being equal to a height difference between the top surface of the lateral mounting portion and the sliding portion; and a docking portion protruding from an end surface of the jumping platform and the docking portion corresponding to the jumping end of the sliding portion in location.

The extendable jumping platform assembly has:

a plurality of aforesaid jumping platforms corresponding in location and juxtaposed with each other; the lateral lapping portion of one of the jumping platforms mounted on the lateral mounting portion of another one of the jumping platforms; the docking portions of the jumping platforms aligned in a row;

a plurality of extending boards, each one of the extending boards comprising:

a sliding portion being a curved surface and on a top surface of the extending board, the sliding portion of each extending board and the sliding portion of the jumping platform having the same curvature variations; the sliding portion of each extending board comprising:

a first proceeding end on one end of the sliding portion; and a second proceeding end on another end of the sliding portion opposite the first proceeding end;

a lateral mounting portion protruding from a lateral surface of the extending board, a top surface of the lateral mounting portion lower than a top surface of the corresponding sliding portion, and the top surface of the lateral mounting portion and the corresponding sliding portion having the same curvature variations;

a lateral lapping portion protruding from another lateral surface of the extending board and curved along with the curvature variation of the corresponding sliding portion, a thickness of the lateral lapping portion being equal to a height difference between the top surface of the corresponding lateral mounting portion and the corresponding sliding portion;

a docking portion protruding from an end surface of the extending board and corresponding to the second proceeding end of the corresponding sliding portion in location;

a connecting portion protruding from another end surface of the extending board and corresponding to the first proceeding end of the corresponding sliding portion in location;

two assembling portions spaced from each other and protruding from a bottom surface of the extending board; and a leg assembly mounted on the assembling portions;

wherein the extending boards correspond in location and are juxtaposed with each other; the lateral lapping portion of one of the extending boards is mounted on the lateral mounting portion of another extending board, and the docking portions of the extending boards are aligned in a row, the connecting portions of the extending boards are mounted on the docking portions of the jumping platforms, the first proceeding ends of the sliding portions of the extending boards are mounted on the jumping ends of the sliding portion of the jumping platform; and a jumping board being an elongated rectangular board and comprising:

two connecting portions respectively protruding from two opposite surfaces of the jumping board in a sliding lengthwise direction; one of the connecting portions of the jumping boards mounted on the docking portion of the extending board, the second proceeding end of the sliding portion connected to a top surface of the jumping board;

two lapping portions respectively protruding from another two opposite surfaces of the jumping board; and a leg assembly mounted on a bottom surface of the jumping board.

The advantages of the present invention are that: with the lateral mounting portion of the jumping platform and the lateral lapping portion, when extending the lateral leaping range of the jumping platforms, the jumping platforms can be juxtaposed in safety for obviating the serrated joint seam. Besides, with the extending board, the sliding length of the sliding portion of the jumping platform can be changed or extended according to the user's need. In addition, when the leaping height of the extendable jumping platform assembly is raised, the extending board can be mounted with a leg assembly which has a corresponding length so that the volume of the extending board is decreased significantly and thereby the costs of material, molding and packaging are also decreased.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
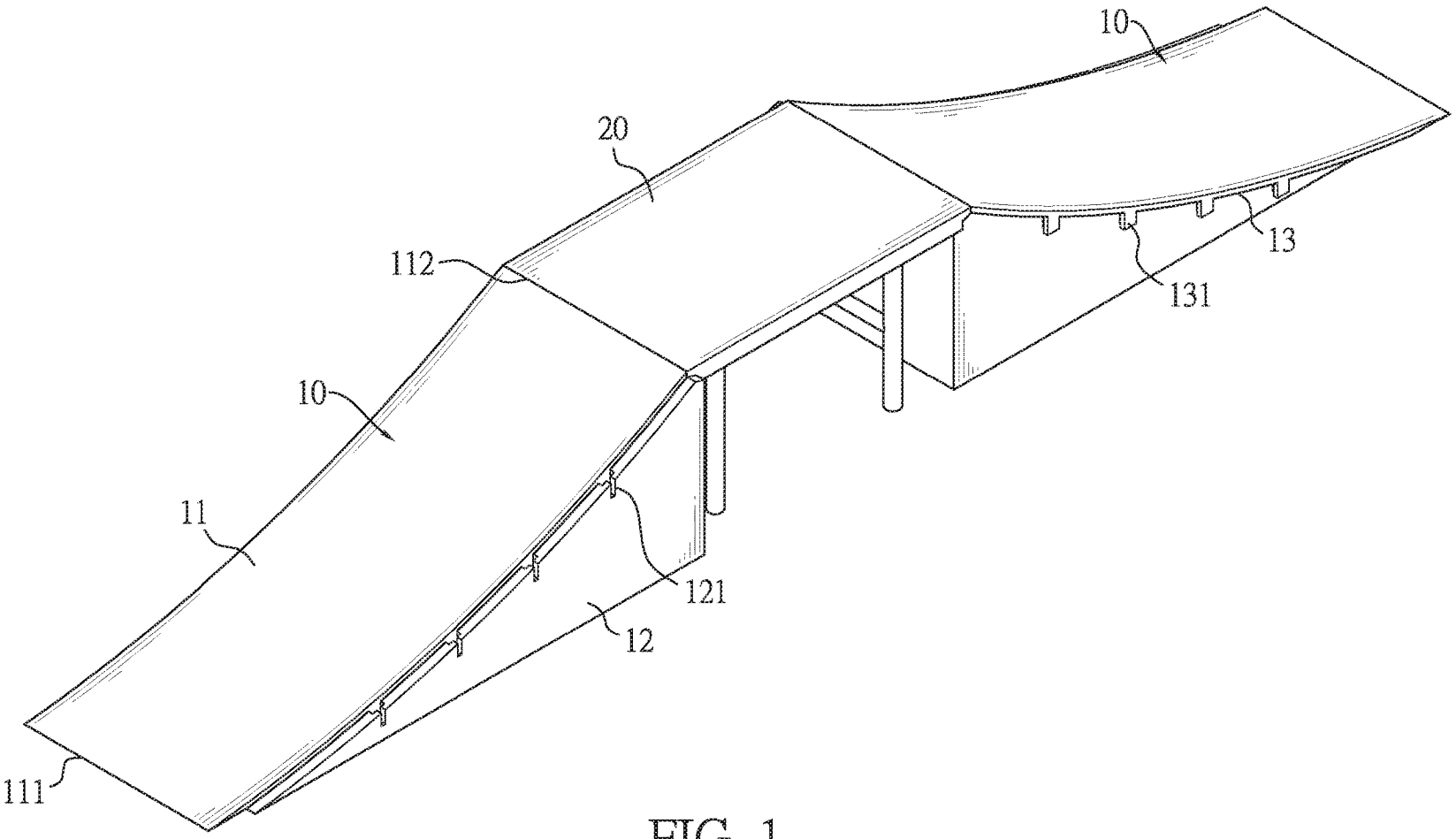
FIG. 1 is a perspective view of a jumping platform in accordance with the first embodiment of the present invention.
Figure 2:
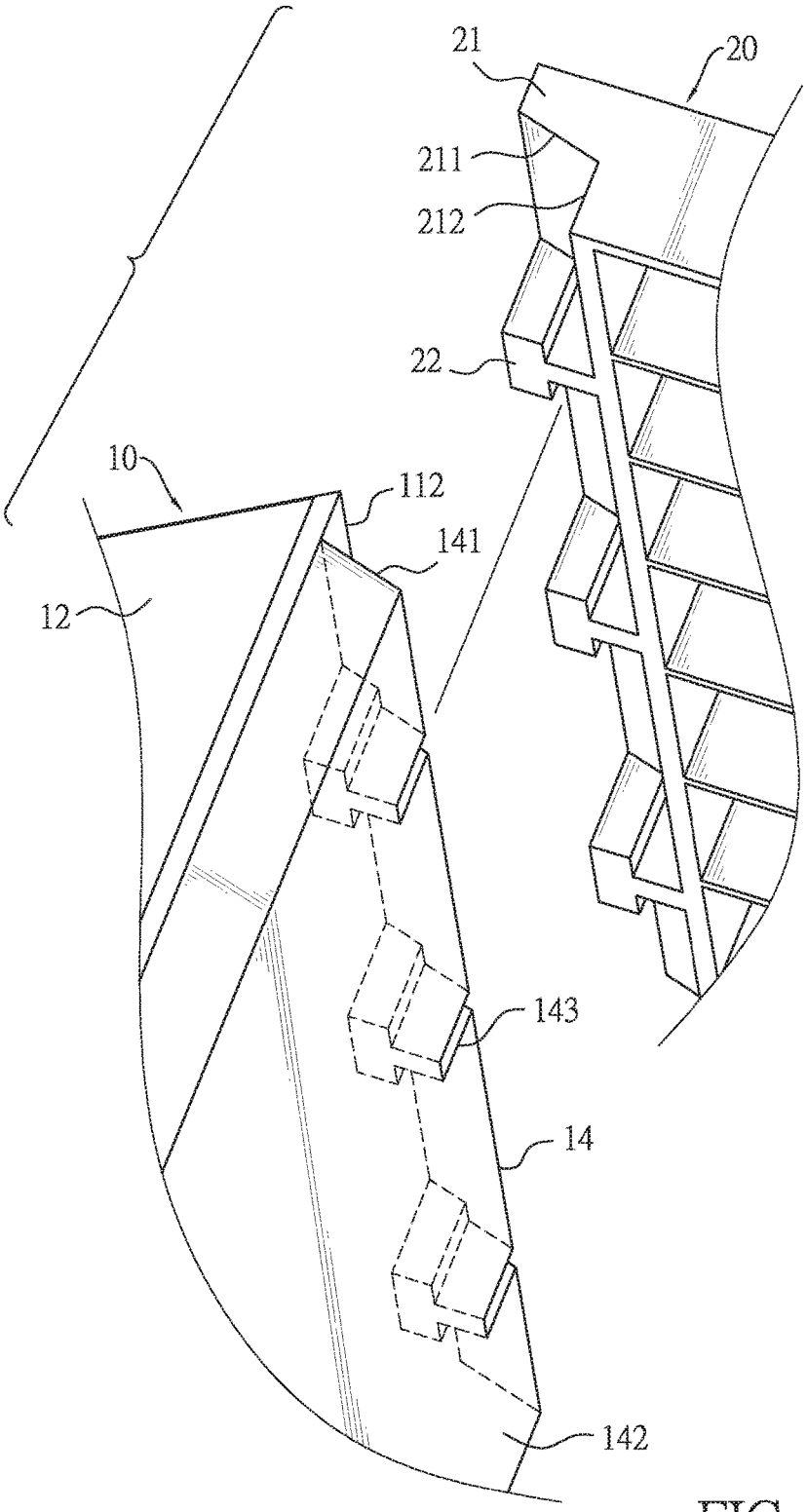
FIG. 2 is a partial exploded perspective view of the jumping platform in FIG. 1.

With reference to FIGS. 1 and 2, an extendable jumping platform assembly in accordance with the first embodiment of the present invention comprises two jumping platforms 10 and a connecting platform 20. Each one of the jumping platforms 10 is an elongated body and comprises a sliding portion 11, a lateral mounting portion 12, a lateral lapping portion 13 and a docking portion 14.

The sliding portion 11 is a curved surface formed on a top of the jumping platform 10 and comprises a guiding end 111 and a jumping end 112.

The guiding end 111 is at the lowest end of the jumping platform 10.

The jumping end 112 is at the highest end of the jumping platform 10. A height of the sliding portion 11 increases from the guiding end 111 to the jumping end 112 in a longitudinal direction of the jumping platform 10.

The lateral mounting portion 12 protrudes from a lateral surface of the jumping platform 10. A top surface of the lateral mounting portion 12 is lower than a top surface of the sliding portion 11. The lateral mounting portion 12 and the sliding portion 11 have the same curvature variations. The lateral mounting portion 12 comprises a plurality of mounting grooves 121 which are spaced apart from each other and concaved on the top surface of the lateral mounting portion 12. Each one of the mounting grooves 121 forms an opening on a surface of the lateral mounting portion 12, said surface away from the sliding portion 11. A sectional shape of each mounting groove 121 is T-shaped.

The lateral lapping portion 13 protrudes from another lateral surface of the jumping platform 10 and is curved along with the curvature variation of the sliding portion 11. A thickness of the lateral lapping portion 13 is equal to a height difference between the top surface of the lateral mounting portion 12 and the sliding portion 11. The lateral lapping portion 13 comprises a plurality of mounting tenons 131 which are spaced apart from each other and protrude from a bottom surface of the lateral lapping portion 13. Locations of the mounting tenons 131 and distances between the mounting tenons 131 are corresponding to the mounting grooves 121. In addition, sectional shapes of the mounting tenons 131 and the sectional shapes of the mounting grooves 121 are the same. In other words, the sectional shapes of the mounting tenons 131 of the lateral lapping portion 13 are also T-shaped.

The docking portion 14 protrudes from an end surface of the jumping platform 10 and corresponds to the jumping end 112 of the sliding portion 11 in location. The docking portion 14 comprises a supporting surface 141, a docking surface 142 and a plurality of mounting grooves 143.

The supporting surface 141 is oblique and is a top surface of the docking portion 14.

The docking surface 142 is an end surface of the docking portion 14, said end surface is away from the sliding portion 11. The docking surface 142 is connected to the supporting surface 141.

The mounting grooves 143 are spaced apart from each other and concaved on the supporting surface 141. A sectional shape of each one of the mounting grooves 143 is T-shaped and each one of the mounting grooves 143 forms an opening on the docking surface 142.

The connecting platform 20 comprises two connecting portions 21 and a plurality of mounting tenons 22.

The two connecting portions 21 are formed on two opposite ends of the connecting platform 20 and each one of the two connecting portions 21 comprises a pressing surface 211 and a connecting surface 212.

The pressing surface 211 is oblique on a bottom surface of the connecting portion 21, and the connecting surface 212 is connected to the pressing surface 211.

The mounting tenons 22 are spaced apart from each other and protrude from the pressing surfaces 211 of the connecting portions 21.

In the first embodiment of the present invention, the jumping ends 112 of the two jumping platforms 10 face to each other and the docking portions 14 of the two jumping platforms 10 are mounted on the two connecting portions 21 of the connecting platform 20 respectively.

The pressing surfaces 211 of the connecting portions 21 of the connecting platform 20 abut on the supporting surfaces 141 of the docking portions 14 of the jumping platforms 10 respectively, the connecting surfaces 212 of the connecting platform 20 abut on the docking surface 142 of the jumping platforms 10 respectively, and the mounting tenons 22 of the connecting platform 20 are mounted in the mounting grooves 143 of the jumping platforms 10 respectively.

Figure 3:
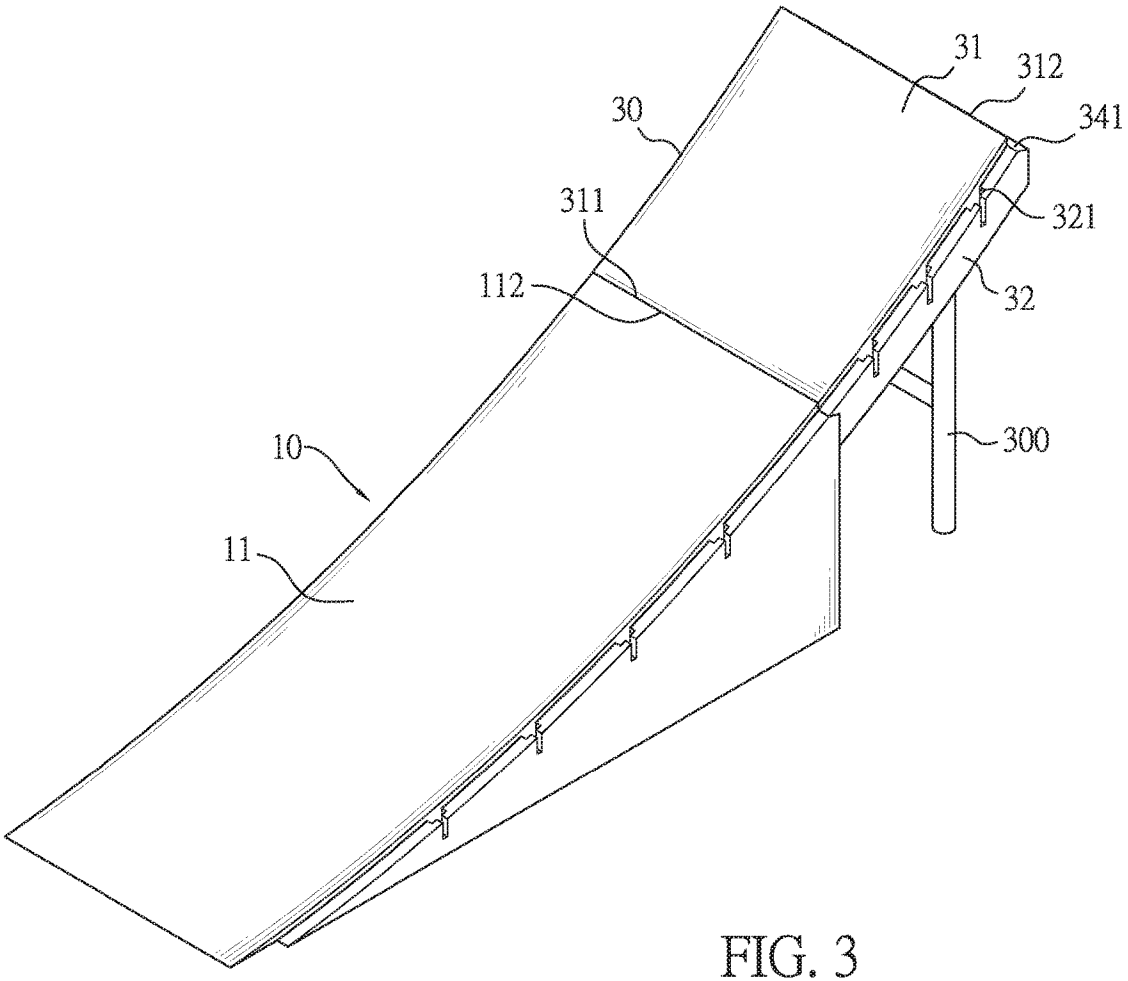
FIG. 3 is a perspective view of a jumping platform in accordance with the second embodiment of the present invention.

In the second embodiment of the present invention, as shown in FIG. 3, the extendable jumping platform assembly comprises a jumping platform 10 and an extending board 30.

Figure 4:
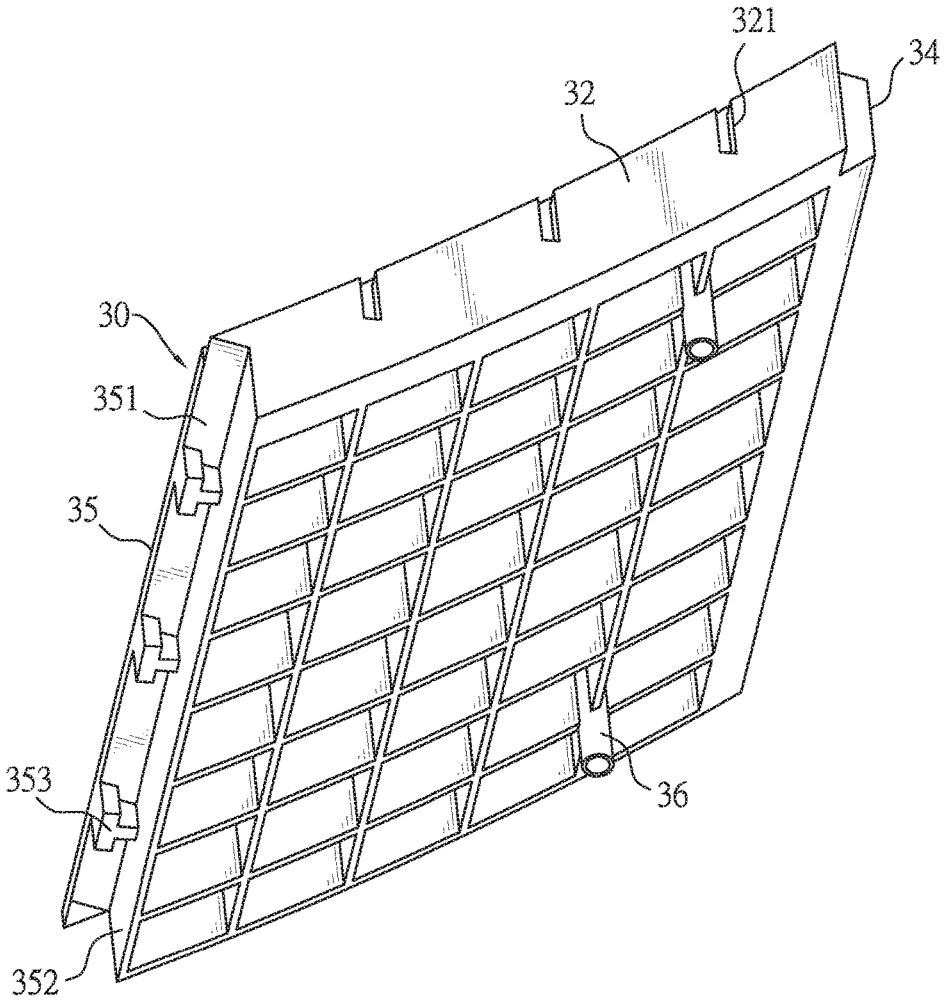
FIG. 4 is a perspective view of the extending board in FIG. 3.
Figure 5:
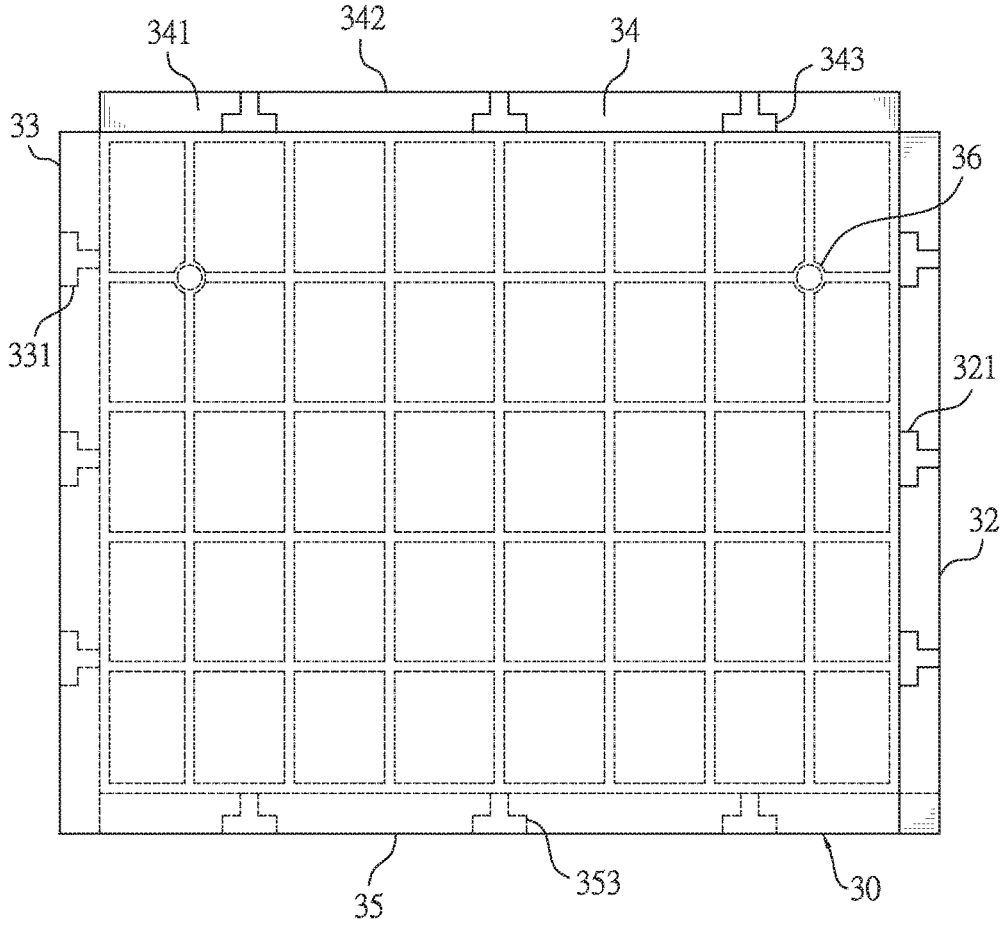
FIG. 5 is a top perspective view of the extending board in FIG. 3.

Please refer to FIGS. 3 to 5. The extending board 30 comprises a sliding portion 31, a lateral mounting portion 32, a lateral lapping portion 33, a docking portion 34, a connecting portion 35, two assembling portions 36, and a leg assembly 300.

The sliding portion 31 is a curved surface formed on a top of the extending board 30 and comprises a first proceeding end 311 and a second proceeding end 312. The sliding portion 31 of the extending board 30 and the sliding portion 11 of the jumping platform 10 have the same curvature variations.

The first proceeding end 311 and the second proceeding end 312 are two opposite ends of the sliding portion 31 of the extending board 30.

The lateral mounting portion 32 protrudes from a lateral surface of the extending board 30. A top surface of the lateral mounting portion 32 is lower than a corresponding portion of the top surface of the corresponding sliding portion 31, and the lateral mounting portion 32 and the corresponding sliding portion 31 have the same curvature variations.

The lateral mounting portion 32 comprises a plurality of mounting grooves 321, the mounting grooves 321 are spaced apart from each other and concaved on the top surface of the lateral mounting portion 32, and each one of the mounting grooves 321 forms an opening on a surface of the lateral mounting portion 32 away from the corresponding sliding portion 31. Precisely, sectional shapes of the mounting grooves 321 are T-shaped.

The lateral lapping portion 33 protrudes from the other lateral surface of the extending board 30 and is curved along with the curvature variation of the sliding portion 31. A thickness of the lateral lapping portion 33 is equal to a height difference between the top surface of the lateral mounting portion 32 and the corresponding sliding portion 31.

The lateral lapping portion 33 comprises a plurality of mounting tenons 331 spaced apart from each other and protruding from a bottom surface of the lateral lapping portion 33. Locations of the mounting tenons 331 and distances between the mounting tenons 331 correspond to the mounting grooves 321 of the extending board 30. Besides, sectional shapes of the mounting tenons 331 and the sectional shapes of the mounting grooves 321 are the same. In other words, the sectional shapes of the mounting tenons 331 are also T-shaped.

The docking portion 34 protrudes from an end surface of the extending board 30 and corresponds to the second proceeding end 312 of the corresponding sliding portion 31 in location. The docking portion 34 comprises a supporting surface 341, a docking surface 342, and a plurality of mounting grooves 343.

The supporting surface 341 is oblique on a top surface of the docking portion 34.

The docking surface 342 is an end surface of the docking portion 34 that is away from the sliding portion 31 of the extending board 30. The docking surface 342 is connected to the supporting surface 341.

The mounting grooves 343 are spaced apart from each other and concaved on the supporting surface 341. A sectional shape of each one of the mounting grooves 343 is T-shaped, and each one of the mounting grooves 343 forms an opening on the docking surface 342.

The connecting portion 35 protrudes from the other end surface of the extending board 30 and corresponds to the first proceeding end 312 of the sliding portion 31 in location. The connecting portion 35 comprises a pressing surface 351, a connecting surface 352 and a plurality of mounting tenons 353.

The pressing surface 351 is oblique on a bottom surface of the connecting portion 35. The connecting surface 352 is connected to the pressing surface 351.

The mounting tenons 353 are spaced apart from each other and protrude from the pressing surface 351. A sectional shape of each one of the mounting tenons 353 is T-shaped.

The two assembling portions 36 are spaced from each other and protrude from a bottom surface of the extending board 30. The leg assembly 300 is mounted on the two assembling portions 36.

Figure 6:
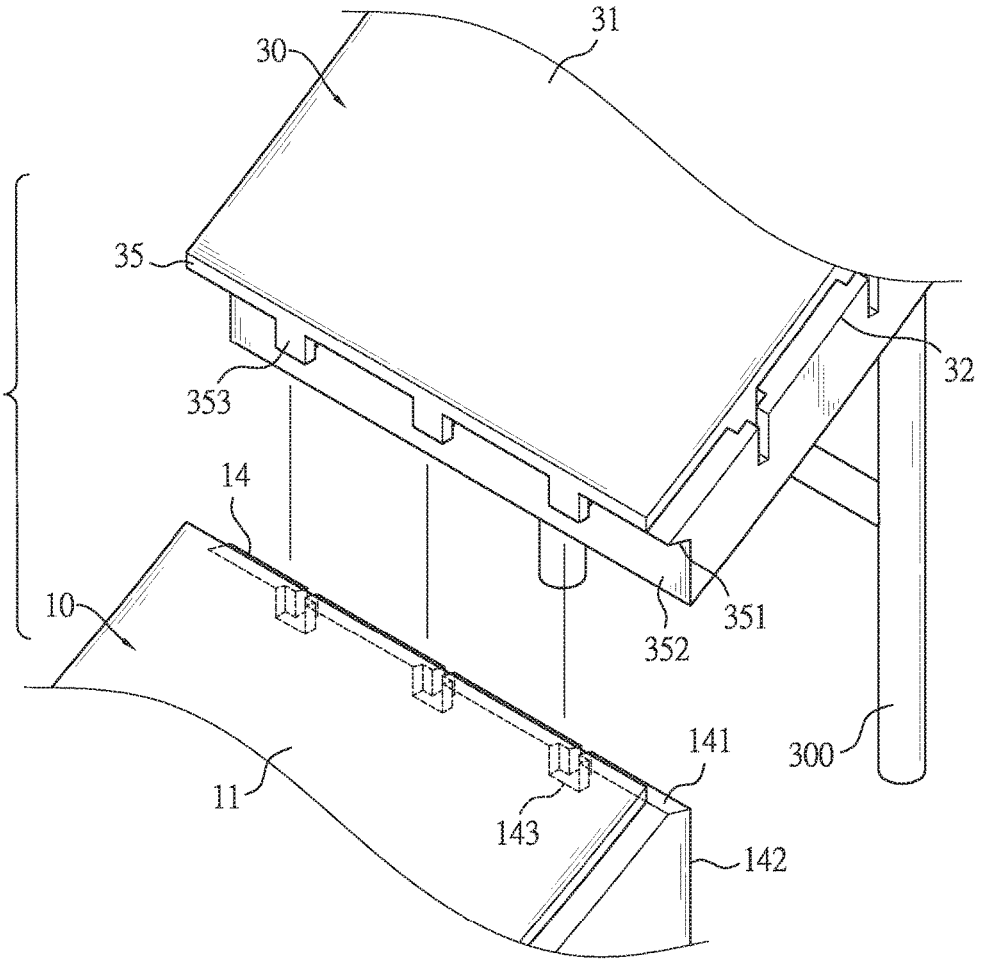
FIG. 6 is a partial exploded perspective view of the jumping platform in FIG. 3.

FIGS. 3 and 6 describe the assembled jumping platform 10 and extending board 30. The pressing surface 351 of the connecting portion 35 of the extending board 30 abuts the supporting surface 141 of the docking portion 14 of the jumping platform 10, the connecting surface 352 of the extending board 30 abuts the docking surface 142 of the jumping platform 10, the mounting tenons 353 of the extending board 30 are mounted in the mounting grooves 143 of the jumping platform 10, and the first proceeding end 311 of the sliding portion 31 of the extending board 30 is connected to the jumping end 112 of the sliding portion 11 of the jumping platform 10.

Figure 7:
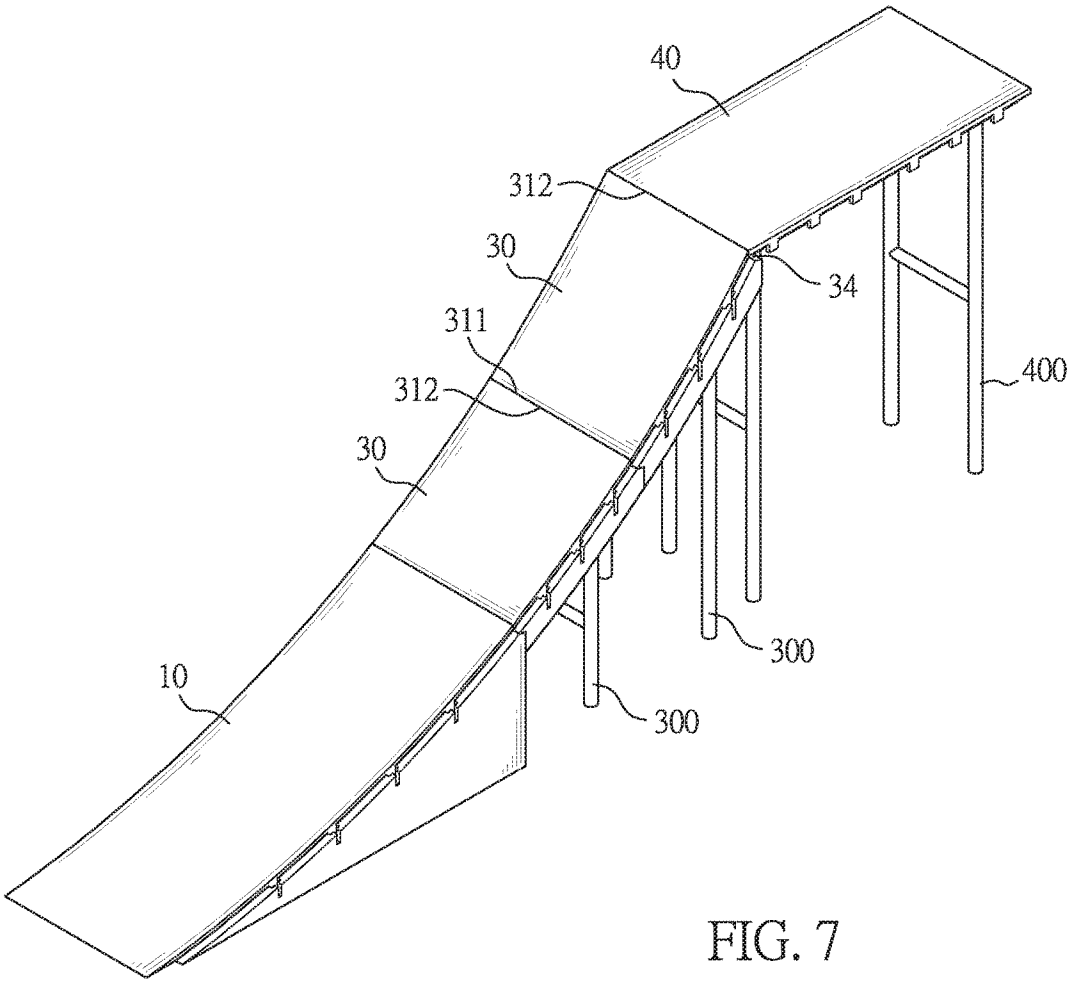
FIG. 7 is a perspective view of an extendable jumping platform assembly in accordance with the third embodiment of the present invention.

The assembly of the jumping platform 10 and the extending board 30 is not limited by the aforesaid second embodiment. FIG. 7 describes the third embodiment of the present invention, where the extendable jumping platform assembly further comprises another extending board 30 and a jumping board 40 so that the sliding length can be extended.

One of the two extending boards 30 is assembled in the jumping platform 10 and the first proceeding end 311 of the other extending board 30 is connected to the second proceeding end 312 of the preceding extending board 30. A height of the leg assembly 300 of the subsequent extending board 30 is increased along with a sliding direction. The jumping board 40 is assembled in the subsequent extending board 30 and connected to the second proceeding end 312 of the subsequent extending board 30. Similarly, leg assembly 400 with a corresponding height can be mounted on a bottom surface of the jumping board 40 for extending the sliding length.

Figure 8:
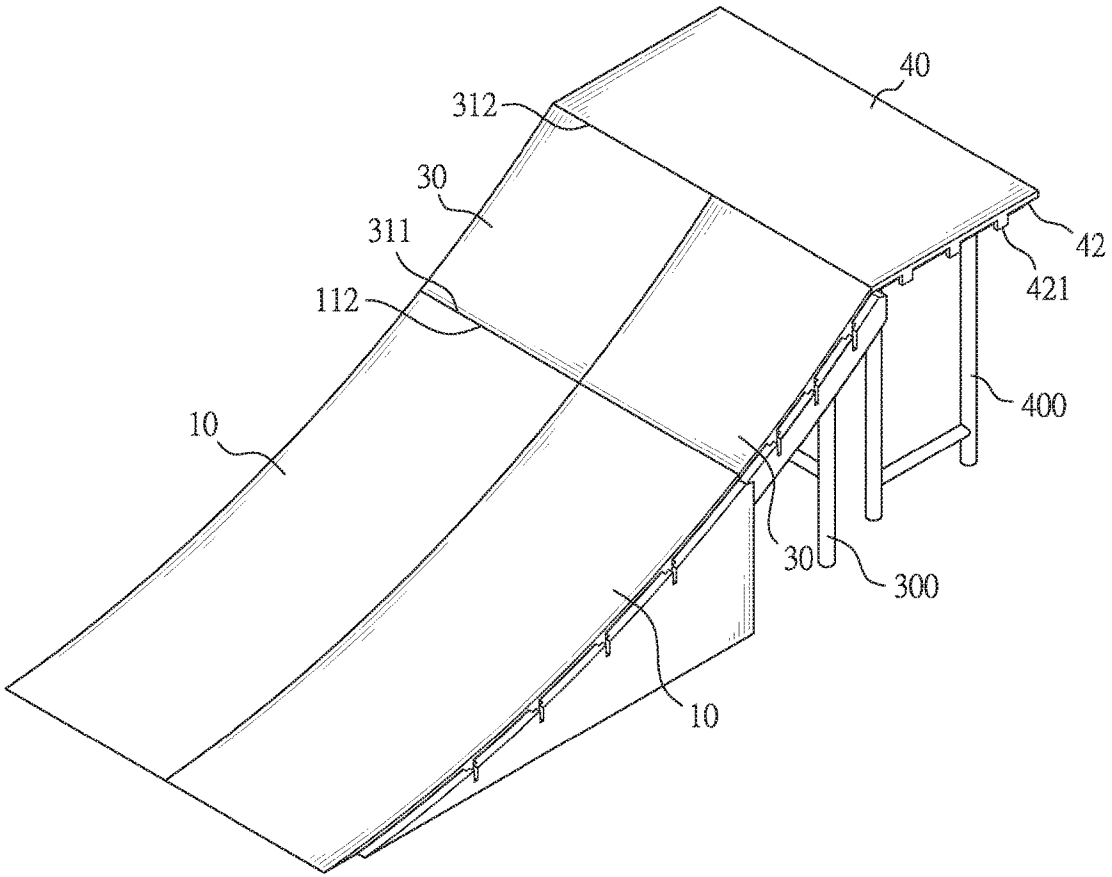
FIG. 8 is a perspective view of an extendable jumping platform assembly in accordance with the fourth embodiment of the present invention.
Figure 9:
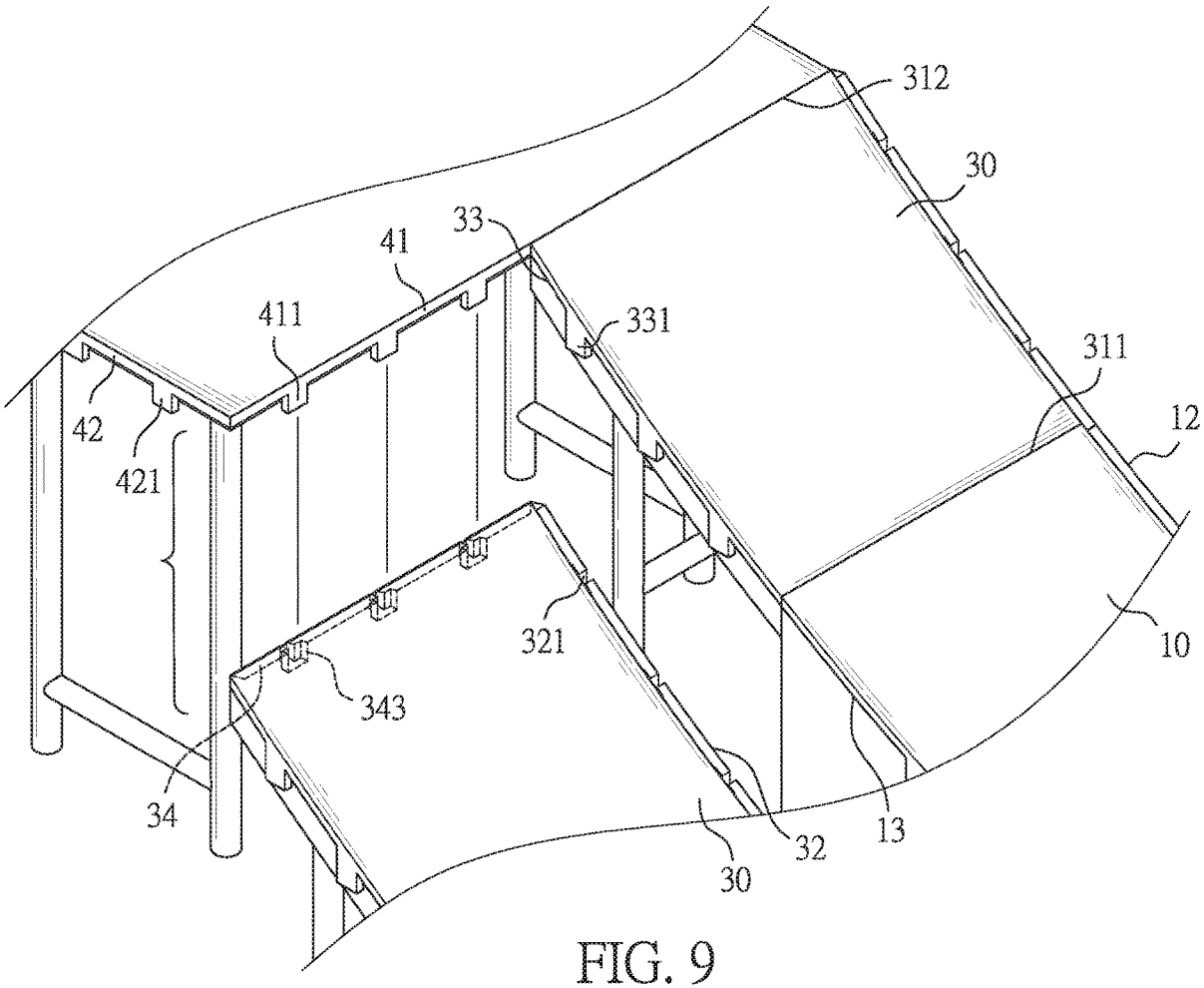
FIG. 9 is a partial exploded perspective view of FIG. 8.
Figure 10:
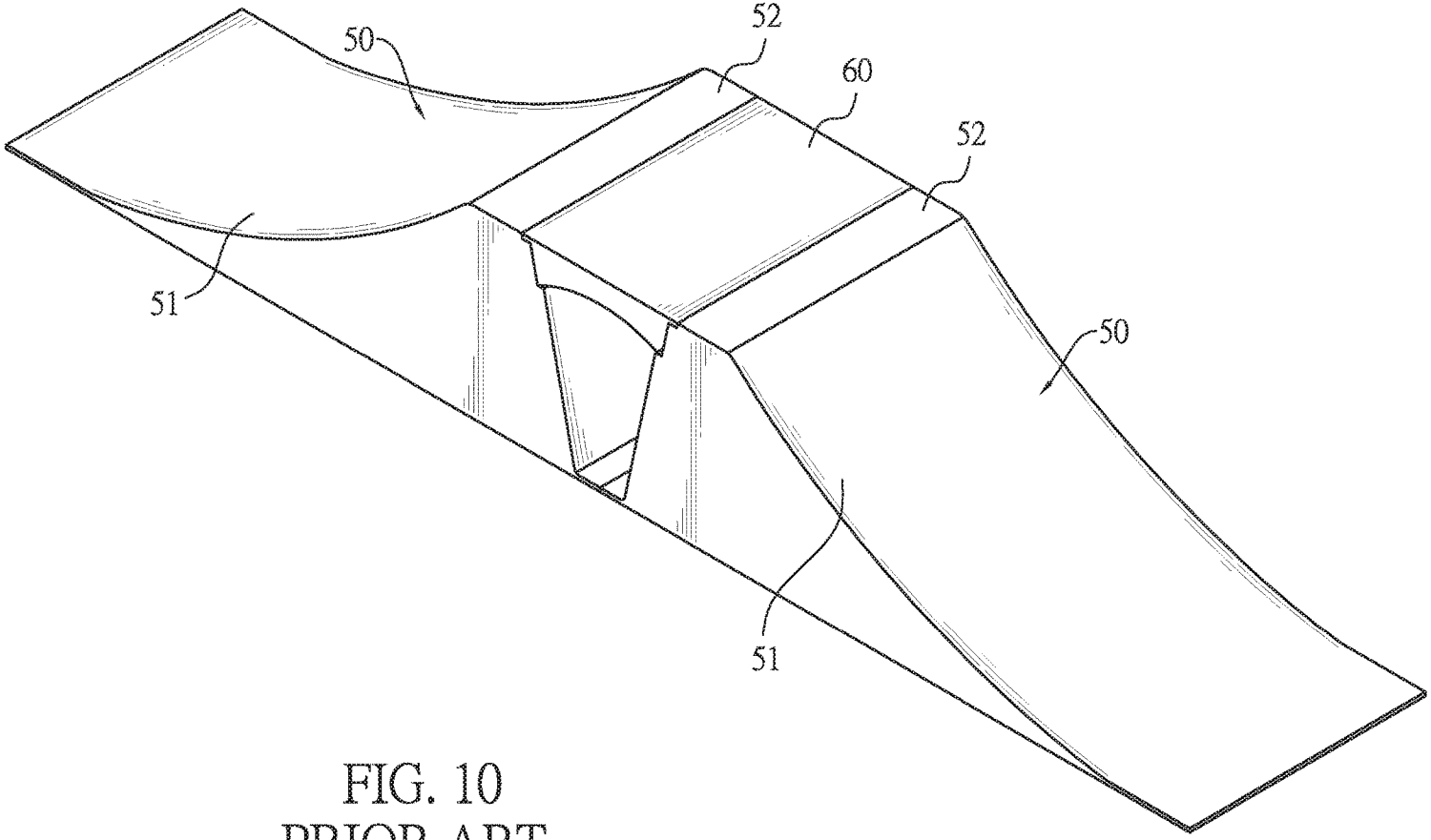
FIG. 10 PRIOR ART
FIG. 10 is a perspective view in accordance with a conventional extendable jumping platform assembly.
Figure 11:
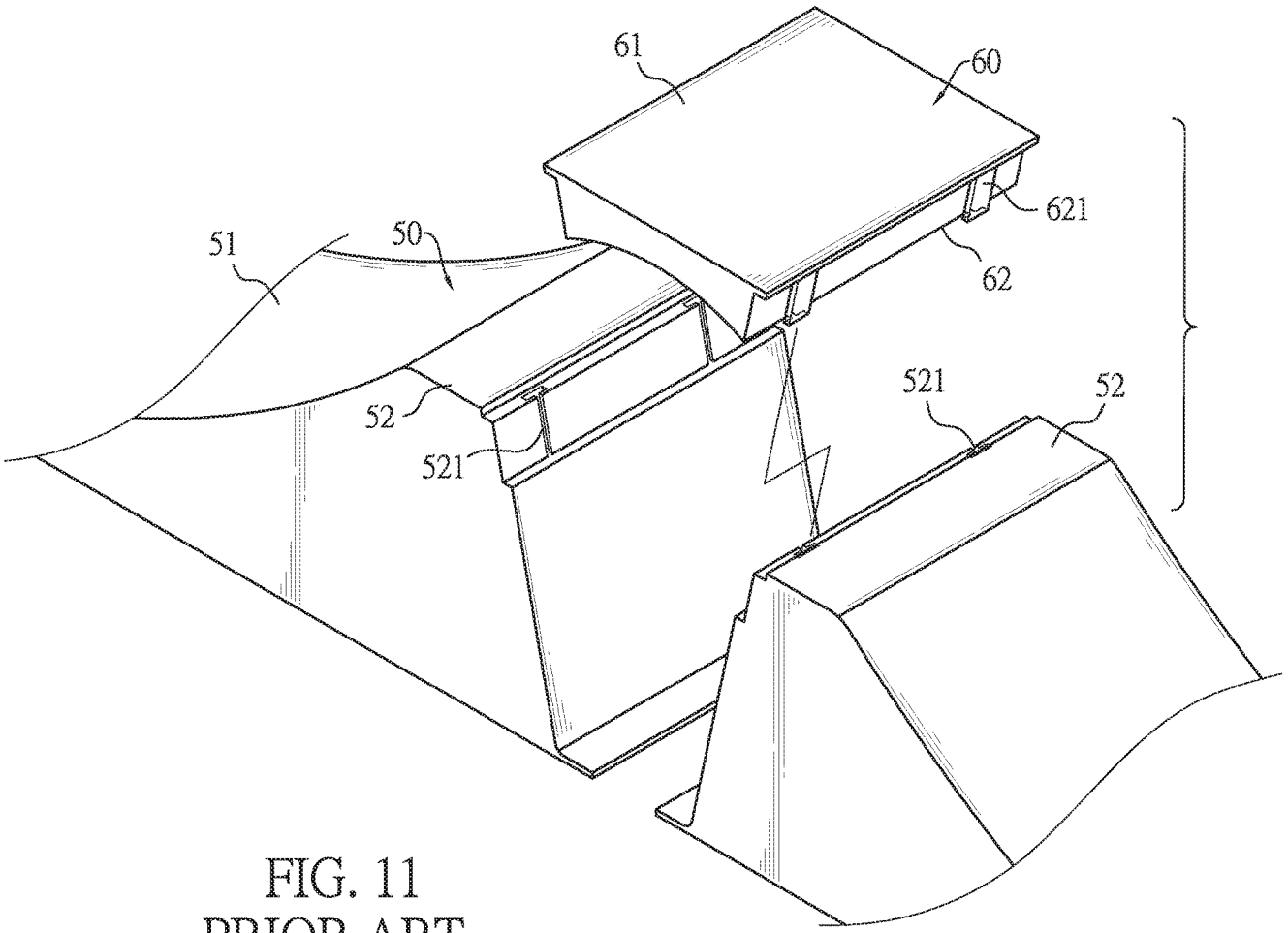
FIG. 11 PRIOR ART
FIG. 11 is a partial exploded perspective view of FIG. 10.
Figure 12:
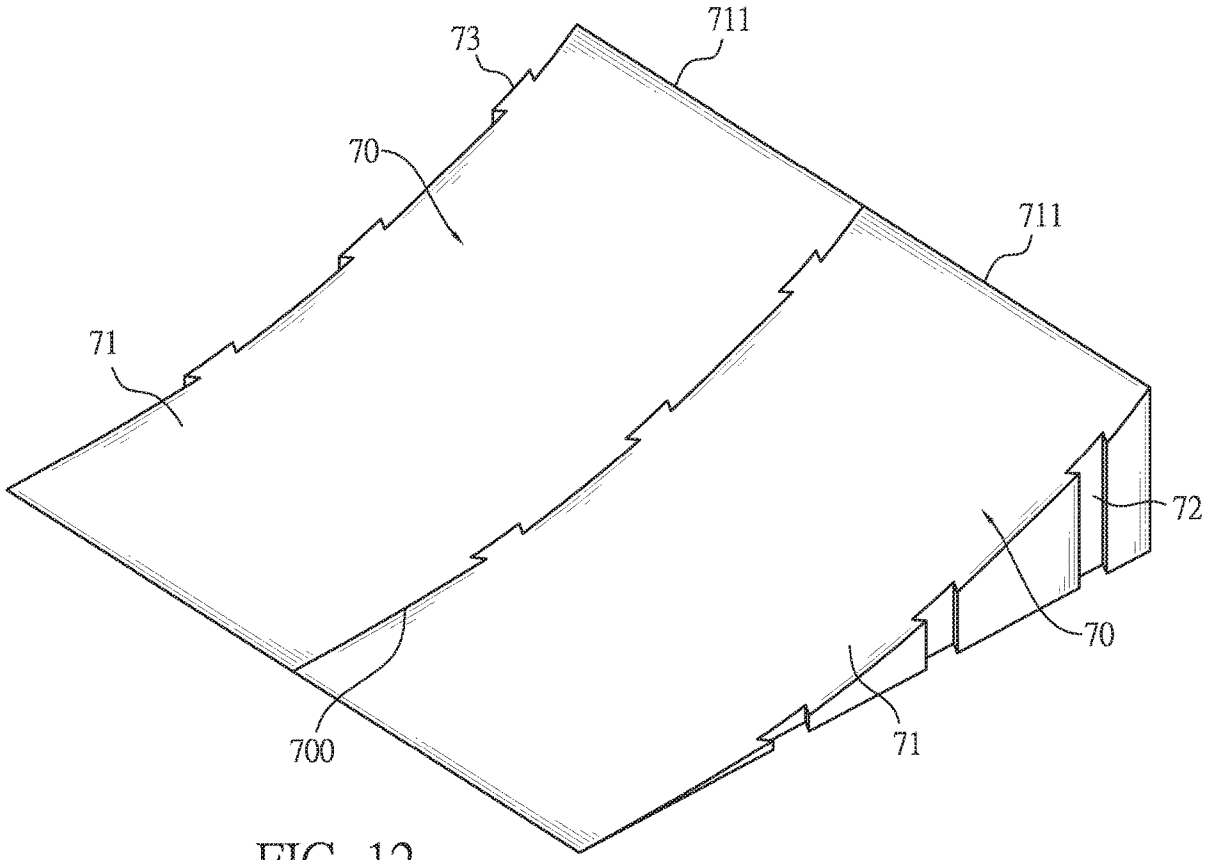
FIG. 12 PRIOR ART
FIG. 12 is a perspective view in accordance with another conventional extendable jumping platform assembly.
Figure 13:
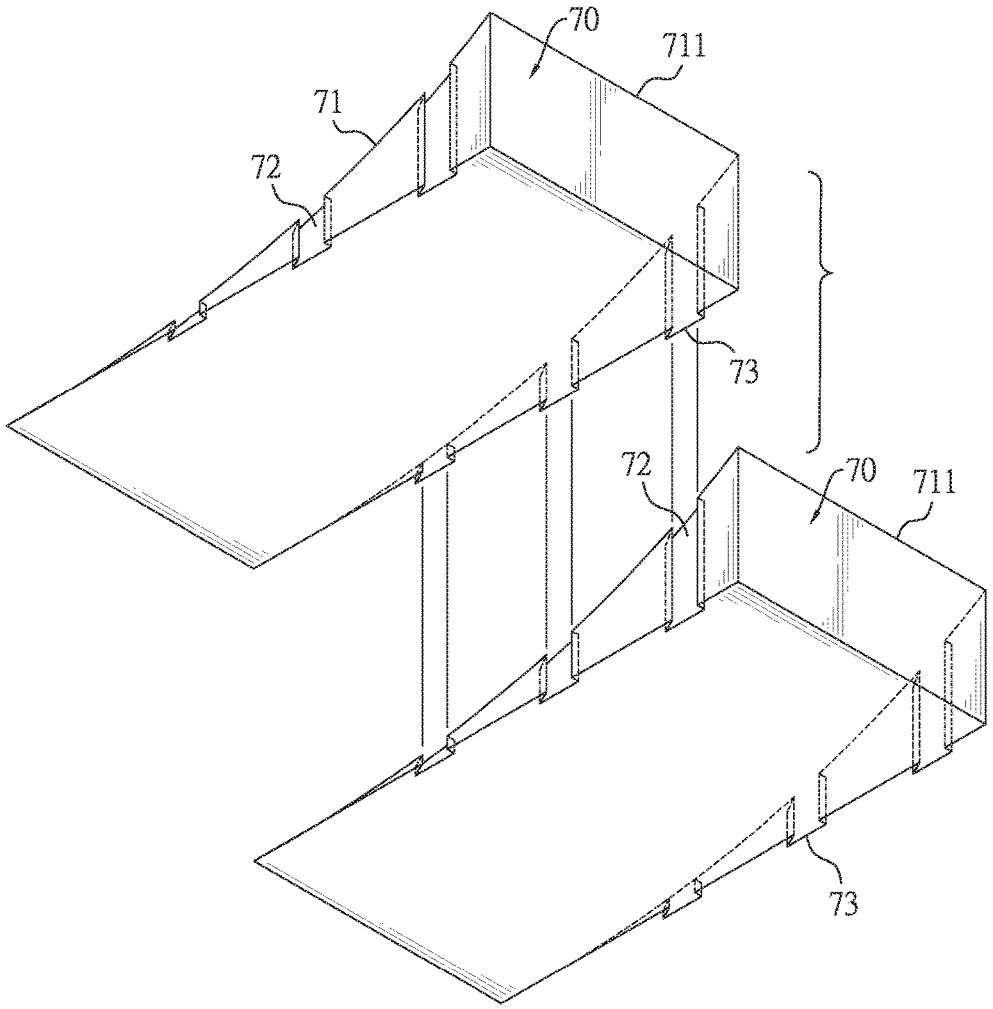
FIG. 13 PRIOR ART
FIG. 13 is a partial exploded perspective view of FIG. 12.
Figure 14:
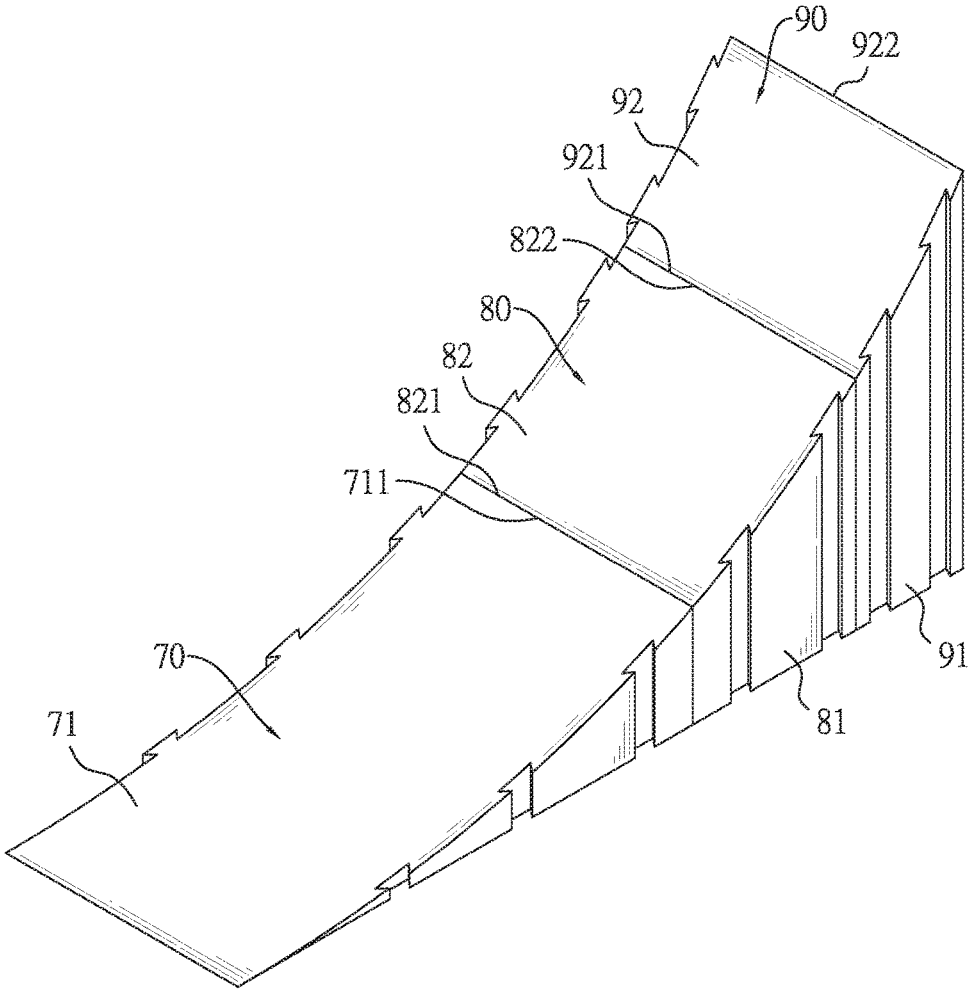
FIG. 14 PRIOR ART
FIG. 14 is a perspective view in accordance with still another conventional extendable jumping platform assembly.
Figure 15:
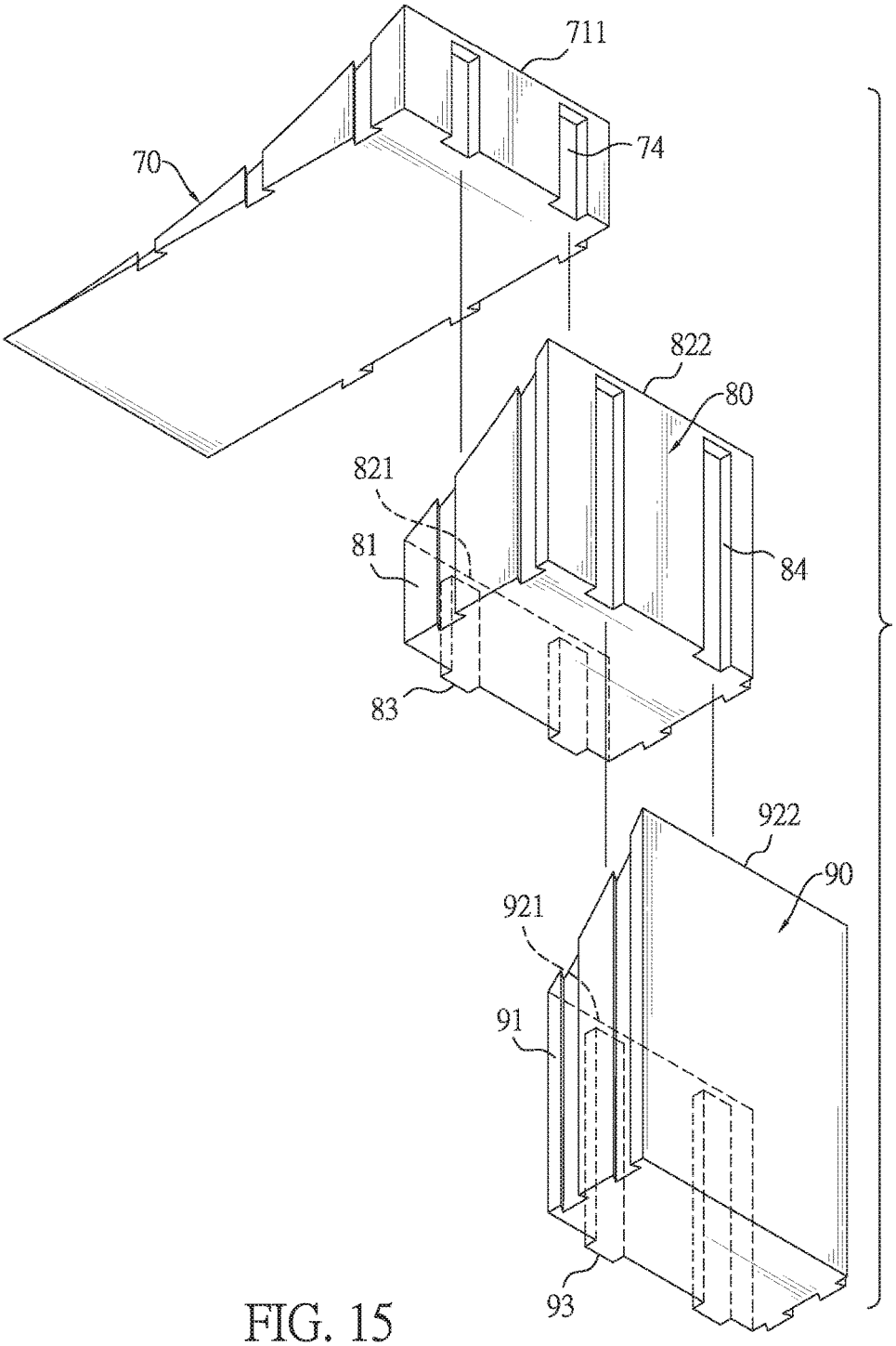
FIG. 15 PRIOR ART
FIG. 15 is a partial exploded perspective view of FIG. 14.

Please refer to FIGS. 8 and 9. In the fourth embodiment, the extendable jumping platform assembly comprises a plurality of the aforesaid jumping platforms 10, a plurality of the aforesaid extending boards 30, and one of the aforesaid jumping boards 40 so that the lateral leaping range can be extended.

The jumping platforms 10 correspond in location and are juxtaposed with each other. The lateral lapping portion 13 of one of the jumping platforms 10 is mounted on the lateral mounting portion 12 of another jumping platform 10. The docking portions 14 of the plurality of jumping platforms 10 are aligned in a row.

The plurality of extending boards 30 correspond in location and are juxtaposed each other. The lateral lapping portion 33 of one of the extending boards 30 is mounted on the lateral mounting portion 32 of another extending board 30. The docking portions 34 of the plurality of extending boards 30 are aligned in a row. The connecting portions 35 of the extending boards 30 are mounted on the docking portions 14 of the jumping platforms 10 as shown in FIG. 6.

The jumping board 40 is an elongated rectangular board and comprises two connecting portions 41, two lapping portions 42, and the leg assembly 400.

The two connecting portions 41 protrude from two opposite surfaces of the jumping board 40 in a sliding lengthwise direction. Each one of the connecting portions 41 comprises a plurality of mounting tenons 411 spaced apart from each other. One of the connecting portions 41 can be mounted on the docking portions 34 of the extending boards 30, and the mounting tenons 411 of the jumping board 40 are mounted in the plurality of mounting grooves 343 of the extending boards 30.

The two lapping portions 42 protrude from the other two opposite surfaces of the jumping board 40, and each one of the lapping portions 42 forms a plurality of mounting tenons 421 spaced apart from each other.

Structures of each one of the connecting portions 41 and the lapping portions 42 of the jumping board 40 and the connecting portion 21 of the connecting platform 20 are the same. In other words, each one of the connecting portions 41 and the lapping portions 42 also comprises a pressing surface (not illustrated in the drawings) and a connecting surface (not illustrated in the drawings) but detailed descriptions thereof are omitted. The mounting tenons 411 protrude from the pressing surface (not illustrated in the drawings) of the connecting portion 41. After assembly, the pressing surface (not illustrated in the drawings) of the connecting portion 41 of the jumping board 40 abuts the supporting surface 341 of the extending board 30. Please also refer to FIGS. 5 and 9: the connecting surface (not illustrated in the drawings) of the connecting portion 41 of the jumping board 40 abuts the docking surface 342 of the extending board 30.

In the present invention, with the lateral mounting portion 12 and lateral lapping portion 13 of the jumping platform 10, the lateral leaping range of the present extendable jumping platform assembly is extended. Besides, with the lateral lapping portion 13 disposed above the lateral mounting portion 12 for juxtaposing the plurality of jumping platforms 10, the present invention mitigates the serrated joint seam of the conventional extendable jumping platform assembly. In addition, with the extending board 30 assembled in the jumping platform 10, the sliding length can be changed according to different usages. Furthermore, when the leaping height of the extendable jumping platform assembly rises, the extending board 30 can be mounted with a leg assembly 300 which has a corresponding length so that the volume of the extending board 30 is decreased significantly and thereby the costs of material, molding and packaging are also decreased.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A jumping platform which is an elongated body and comprises:

a sliding portion being a curved surface and formed on a top surface of the jumping platform, the sliding portion comprising:

a guiding end at the lowest end of the jumping platform; and a jumping end at the highest end of the jumping platform; a height of the sliding portion increasing from the guiding end to the jumping end in a longitudinal direction of the jumping platform;

a lateral mounting portion protruding from a lateral surface of the jumping platform, a top surface of the lateral mounting portion being lower than a top surface of the sliding portion, the lateral mounting portion and the sliding portion having the same curvature variations;

a lateral lapping portion protruding from another lateral surface of the jumping platform and curved along with the curved surface of the sliding portion, a thickness of the lateral lapping portion being equal to a height difference between the top surface of the lateral mounting portion and the sliding portion; and a docking portion protruding from an end surface of the jumping platform and the docking portion corresponding to the jumping end of the sliding portion in location.

2. The jumping platform as claimed in claim 1, wherein:

the lateral mounting portion comprises:

a plurality of mounting grooves spaced apart from each other and concaved on the top surface of the lateral mounting portion, and each one of the mounting grooves forming:

an opening on a surface of the lateral mounting portion, said surface being away from the sliding portion; and the lateral lapping portion comprises:

a plurality of mounting tenons spaced apart from each other and protruding from a bottom surface of the lateral lapping portion, locations of the mounting tenons and distances between the mounting tenons corresponding to the mounting grooves; sectional shapes of the mounting tenons and the sectional shapes of the mounting grooves being the same.

3. The jumping platform as claimed in claim 2, wherein the sectional shape of each one of the mounting grooves of the lateral mounting portion is T-shaped, and the sectional shape of each one of the mounting tenons of the lateral lapping portion is also T-shaped.

4. The jumping platform as claimed in claim 3, wherein the docking portion comprises:

a supporting surface being oblique and being a top surface of the docking portion;

a docking surface being an end surface of the docking portion and connected to the supporting surface, said end surface being away from the sliding portion; and a plurality of mounting grooves spaced apart from each other and concaved on the supporting surface; a sectional shape of each one of the mounting grooves being T-shaped, and each one of the mounting grooves forming:

an opening on the docking surface.

5. An extendable jumping platform assembly comprising:

a plurality of the jumping platforms as claimed in claim 4 corresponding in location and juxtaposed with each other; the lateral lapping portion of one of the jumping platforms mounted on the lateral mounting portion of another one of the jumping platforms; the docking portions of the jumping platforms aligned in a row;

a plurality of extending boards, each one of the extending boards comprising:

a sliding portion being a curved surface and on a top surface of the extending board, the sliding portion of each extending board and the sliding portion of the jumping platform having the same curvature variations; the sliding portion of each extending board comprising:

a first proceeding end on one end of the sliding portion; and a second proceeding end on another end of the sliding portion opposite the first proceeding end;

a lateral mounting portion protruding from a lateral surface of the extending board, a top surface of the lateral mounting portion lower than a top surface of the corresponding sliding portion, and the top surface of the lateral mounting portion and the corresponding sliding portion having the same curvature variations;

a lateral lapping portion protruding from another lateral surface of the extending board and curved along with the curvature variation of the corresponding sliding portion, a thickness of the lateral lapping portion being equal to a height difference between the top surface of the corresponding lateral mounting portion and the corresponding sliding portion;

a docking portion protruding from an end surface of the extending board and corresponding to the second proceeding end of the corresponding sliding portion in location;

a connecting portion protruding from another end surface of the extending board and corresponding to the first proceeding end of the corresponding sliding portion in location;

two assembling portions spaced from each other and protruding from a bottom surface of the extending board; and a leg assembly mounted on the assembling portions;

wherein the extending boards correspond in location and are juxtaposed with each other; the lateral lapping portion of one of the extending boards is mounted on the lateral mounting portion of another extending board, and the docking portions of the extending boards are aligned in a row, the connecting portions of the extending boards are mounted on the docking portions of the jumping platforms, the first proceeding ends of the sliding portions of the extending boards are mounted on the jumping ends of the sliding portion of the jumping platform; and a jumping board being an elongated rectangular board and comprising:

two connecting portions respectively protruding from two opposite surfaces of the jumping board in a sliding lengthwise direction; one of the connecting portions of the jumping boards mounted on the docking portion of the extending board, the second proceeding end of the sliding portion connected to a top surface of the jumping board;

two lapping portions respectively protruding from another two opposite surfaces of the jumping board; and a leg assembly mounted on a bottom surface of the jumping board.

6. The jumping platform assembly as claimed in claim 5, wherein:

the connecting portion of each one of the extending boards comprises:

a pressing surface being oblique on a bottom surface of the connecting portion and abutting the supporting surface of the docking portion of one of the jumping platforms;

a connecting surface connected to the pressing surface and abutting the docking surface of the docking portion of the corresponding jumping platform; and a plurality of mounting tenons spaced apart from each other, protruding from the pressing surface, and mounted in the mounting grooves of the docking portion of the corresponding jumping platform; a sectional shape of each one of the mounting tenons being T-shaped.

7. The extendable jumping platform assembly as claimed in claim 6, wherein:

the docking portion of each one of the extending boards comprises:

a supporting surface being oblique on a top surface of the docking portion;

a docking surface being an end surface of the docking portion and connected to the supporting surface, said end surface being away from the sliding portion; and a plurality of mounting grooves spaced apart from each other and concaved on the supporting surface; a sectional shape of each one of the mounting grooves being T-shaped, and each one of the mounting grooves forming:

an opening on the docking surface; and each one of the two connecting portions of each one of the jumping boards comprises:

a pressing surface being oblique on a bottom surface of the corresponding connecting portion and abutting the supporting surface of the docking portion of one of the extending boards;

a connecting surface connected to the pressing surface of the jumping board and abutting the docking surface of the docking portion of the corresponding extending board; and a plurality of mounting tenons spaced apart from each other protruding from the pressing surface of the jumping board, and mounted in the mounting grooves of the docking portion of the corresponding extending boards.

8. The jumping platform as claimed in claim 1, wherein the docking portion comprises:

a supporting surface being oblique and being a top surface of the docking portion;

a docking surface being an end surface of the docking portion and connected to the supporting surface, said end surface being away from the sliding portion; and a plurality of mounting grooves spaced apart from each other and concaved on the supporting surface; a sectional shape of each one of the mounting grooves being T-shaped, and each one of the mounting grooves forming:

an opening on the docking surface.

9. An extendable jumping platform assembly comprising:

a plurality of the jumping platforms as claimed in claim 1 corresponding in location and juxtaposed with each other; the lateral lapping portion of one of the jumping platforms mounted on the lateral mounting portion of another one of the jumping platforms; the docking portions of the jumping platforms aligned in a row;

a plurality of extending boards, each one of the extending boards comprising:

a sliding portion being a curved surface and on a top surface of the extending board, the sliding portion of each extending board and the sliding portion of the jumping platform having the same curvature variations; the sliding portion of each extending board comprising:

a first proceeding end on one end of the sliding portion; and a second proceeding end on another end of the sliding portion opposite the first proceeding end;

a lateral mounting portion protruding from a lateral surface of the extending board, a top surface of the lateral mounting portion lower than a top surface of the corresponding sliding portion, and the top surface of the lateral mounting portion and the corresponding sliding portion having the same curvature variations;

a lateral lapping portion protruding from another lateral surface of the extending board and curved along with the curvature variation of the corresponding sliding portion, a thickness of the lateral lapping portion being equal to a height difference between the top surface of the corresponding lateral mounting portion and the corresponding sliding portion;

a docking portion protruding from an end surface of the extending board and corresponding to the second proceeding end of the corresponding sliding portion in location;

a connecting portion protruding from another end surface of the extending board and corresponding to the first proceeding end of the corresponding sliding portion in location;

two assembling portions spaced from each other and protruding from a bottom surface of the extending board; and a leg assembly mounted on the assembling portions;

wherein the extending boards correspond in location and are juxtaposed with each other; the lateral lapping portion of one of the extending boards is mounted on the lateral mounting portion of another extending board, and the docking portions of the extending boards are aligned in a row, the connecting portions of the extending boards are mounted on the docking portions of the jumping platforms, the first proceeding ends of the sliding portions of the extending boards are mounted on the jumping ends of the sliding portion of the jumping platform; and a jumping board being an elongated rectangular board and comprising:

two connecting portions respectively protruding from two opposite surfaces of the jumping board in a sliding lengthwise direction; one of the connecting portions of the jumping boards mounted on the docking portion of the extending board, the second proceeding end of the sliding portion connected to a top surface of the jumping board;

two lapping portions respectively protruding from another two opposite surfaces of the jumping board; and a leg assembly mounted on a bottom surface of the jumping board.

10. The extendable jumping platform assembly as claimed in claim 9, wherein:

the lateral mounting portion of each one of the extending boards comprises:

a plurality of mounting grooves spaced apart from each other and concaved on the top surface of the lateral mounting portion, and each one of the mounting grooves forming:

an opening on a surface of the lateral mounting portion, said surface being away from the corresponding sliding portion; and the lateral lapping portion of each one of the extending boards comprises:

a plurality of mounting tenons spaced apart from each other and protruding from a bottom surface of the lateral lapping portion, locations of the mounting tenons and distances between the mounting tenons corresponding to the mounting grooves of the extending board, and sectional shapes of the mounting tenons and sectional shapes of the mounting grooves being the same.

11. The extendable jumping platform assembly as claimed in claim 10, wherein the sectional shapes of each one of the mounting grooves of the lateral mounting portions of the extending boards are T-shaped, and the sectional shapes of the mounting tenons of the lateral lapping portions of the extending boards are also T-shaped.

* * * * *